United States Patent [19]

Christini et al.

[11] Patent Number: 4,582,532

[45] Date of Patent: Apr. 15, 1986

[54] THERMAL REDUCTION PROCESS FOR PRODUCTION OF CALCIUM USING ALUMINUM AS A REDUCTANT

[75] Inventors: Roy A. Christini, Apollo, Pa.; Marlyn D. Ballain, Colville, Wash.

[73] Assignee: Aluminum Company of America, Pittsburgh, Pa.

[21] Appl. No.: 729,536

[22] Filed: May 2, 1985

[51] Int. Cl.[4] ..... C22B 26/10

[52] U.S. Cl. ..... 75/66; 75/67 R

[58] Field of Search ..... 75/66, 67 R

[56] References Cited

U.S. PATENT DOCUMENTS

| | | | |
|---|---|---|---|
| 2,448,000 | 8/1948 | Kemmer | 75/67 |
| 2,464,767 | 3/1949 | Pidgeon et al. | 75/67 |
| 2,867,527 | 1/1959 | Andrieux et al. | 75/67 |
| 4,204,860 | 5/1980 | Kibby | 75/67 R |
| 4,240,825 | 12/1980 | Tamas | 75/67 R |
| 4,478,637 | 10/1984 | Christini et al. | 75/67 R |

*Primary Examiner*—Peter D. Rosenberg

*Attorney, Agent, or Firm*—Brian D. Smith

[57] ABSTRACT

Calcium is produced by a thermal reduction process in a reaction-condensation system having a reaction zone and a condensation zone. According to the process, a reducing agent is contacted or reacted in the reaction zone with at least a partially molten slag to produce calcium vapor. The calcium vapor is transported from the reaction zone to the condensation zone and condensed therein.

20 Claims, 1 Drawing Figure

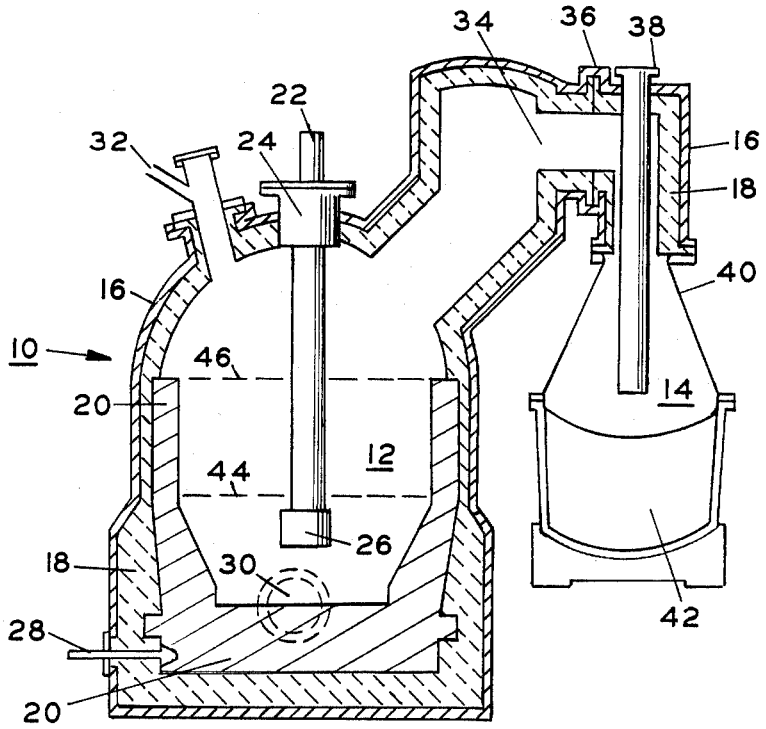
34
36
38
22
32
24
16
18
40
16
10
46
14
20
12
44
26
18
30
42
28
20

THERMAL REDUCTION PROCESS FOR PRODUCTION OF CALCIUM USING ALUMINUM AS A REDUCTANT

BACKGROUND OF THE INVENTION

The present invention relates to the production of calcium by the thermal reduction of calcium oxide in the presence of a molten oxide slag. More particularly, this invention relates to the production of calcium by contacting or reacting an aluminum reducing agent with a molten calcium-aluminum oxide slag or with calcium oxide in the presence of such slag.

Several processes for the production of calcium by thermal reduction are known. These processes generally operate to react calcium oxide in the solid state with a metallic reducing agent, such as silicon or aluminum or mixtures or alloys thereof.

U.S. Pat. No. 2,464,767 to Pidgeon et al (hereinafter referred to as the Pidgeon Process) describes a solid state reaction process for the production of calcium. In carrying out this process, finely ground calcium oxide ore, preferably high calcium limestone, is mixed with finely ground aluminum and formed into small dense briquettes having a density of about 2.2. In a preferred embodiment, an excess of the theoretical amount of aluminum required to reduce the calcium oxide (i.e., an excess of from 5 to 20%) is mixed in the briquettes. The briquettes are charged to a gas-fired or electrically heated retort having a reaction zone and a water-cooled condensation zone. The retort is evacuated and heated so that the temperature in the reaction zone is about 1170° C. Typically, the pressure in the reaction zone is less than 10 microns (i.e., 0.01 torr). Under these conditions, the aluminum reacts with the calcium oxide ore to produce calcium vapor which is conducted to the condensation zone, where it is condensed as a solid.

Another thermal reduction process utilizing a solid state reaction is described in U.S. Pat. No. 2,448,000 of Kemmer. This process is described in the context of producing magnesium, but it is mentioned that the process is applicable to calcium and other alkaline earth metals as well. The process utilizes aluminum as the reducing agent, but also requires the addition of a moderating agent to the reaction zone. This moderating agent consists of aluminum nitride, a mixture of aluminum nitride, aluminum carbide and aluminum oxide or a mixture of ferrosilicon, aluminum nitride, aluminum carbide and aluminum oxide. In one embodiment of this process, there is used as a combined reducing agent and moderating agent "the dross which is obtained in melting and subsequently casting aluminum or aluminum alloys", provided that the dross contains about 0.5 to 10% by weight aluminum nitride.

U.S. Pat. No. 4,240,825 to Tamas describes another solid state, thermal reduction process for the production of calcium. According to the process, calcined lime is reduced under a pressure lower than 10 torr and at a temperature of 1300° to 1600° C. with a reducing agent containing silicon and aluminum in a weight ratio of 4:1 to 1:1, wherein the total amount of silicon and aluminum in the reducing agent may vary between 50 and 100% by weight. 100 to 200 parts by weight of the reducing agent are applied to convert 700 to 1000 parts by weight of calcined lime. The process provides cement as by-product instead of a useless slag.

Calcium is presently produced commercially by solid state processes similar to the previously described Pidgeon Process. The retorts in which the calcium is produced are relatively small and, thus, yields per retort are rather low. As a result, a significant number of retorts are needed for commercial production. Moreover, the operation and maintenance of such a number of retorts require a significant labor force.

Accordingly, it would be most desirable if a higher yielding, less labor intensive process for producing calcium were available.

SUMMARY OF THE INVENTION

An object of the present invention is to provide a liquid state, thermal reduction process for the production of calcium. Another object of the present invention is to provide a liquid state, thermal reduction process for the production of calcium which utilizes a low-cost but highly reactive reducing agent. Another object is to provide a high yielding and low labor intensive process for the production of calcium which can be produced in production facilities conventionally used for producing magnesium. Still yet another object of this invention is to provide a process for the production of high purity calcium for specialty markets.

In accordance with these and other objects, the invention comprises a thermal reduction process for producing calcium by a liquid state reaction in a reaction-condensation system having a reaction zone and a condensation zone. According to this process, a calcium oxide containing slag disposed in the reaction zone is preferably contacted with a reducing agent containing aluminum at a temperature maintained between 1500° and 1800° C. and at a pressure below 50 torr for purposes of producing calcium vapor. The calcium vapor is then transported from the reaction zone to the condensation zone where it is condensed and collected.

The slag should be maintained to contain from 50 to 70% by weight calcium oxide and 25 to 45% by weight aluminum oxide, the remainder containing less than 5% by weight impurities. A more preferred slag composition is maintained to contain from 50 to 63% by weight calcium oxide and 34 to 47% by weight aluminum oxide, the remainder containing less than 3% by weight impurities.

The aluminum reducing agent referred to above is preferably provided by using low-cost particles of aluminum skim or aluminum shot having a low dust content. The particles should have a size, weight and configuration such that when charged to the reaction zone, a substantial portion of the aluminum in the particles reacts or contacts the molten slag to produce calcium vapor.

In order to facilitate an understanding of the invention, an apparatus in which the process may be practiced is illustrated in the sole FIGURE, and a detailed description of the process follows. It is not intended, however, that the invention be limited to the particular embodiments described or be used in connection with the apparatus shown. Various changes are contemplated such as would ordinarily occur to one skilled in the art to which the invention relates.

BRIEF DESCRIPTION OF THE DRAWING

The sole FIGURE is a schematic elevational cross section of an apparatus which may be used to produce calcium by the process of the present invention.

DESCRIPTION OF THE PREFERRED EMBODIMENTS

As used herein, the term "aluminum skim" means the layer of oxides, with entrapped metal, which is formed on the surface of molten aluminum or aluminum alloys. The oxide portion of aluminum skim is typically formed from oxides introduced into the molten metal or from oxides generated on new metal surfaces exposed to the atmosphere during or after melting. Aluminum skim typically contains from 20 to 95 wt. % aluminum and from 5 to 80 wt. % aluminum oxide. It may also contain small amounts of substances such as magnesium, manganese, magnesium oxide, iron, silicon, copper, sodium and zinc, especially when obtained from aluminum alloys containing such substances. Sand, glass and clay or furnace refractories are also often found in the skim, such as when the skim is that of recycled beverage container scrap.

If skim is employed as the aluminum reducing agent in the process of the present invention, it is important in producing acceptable grade calcium that substances present in the skim, such as manganese, sodium, zinc, other high vapor pressure substances and, surprisingly, copper, not exceed certain limits. These substances are troublesome under process conditions because they tend to vaporize, transport and condense with the calcium vapor, thereby contaminating the calcium produced. The levels of contaminants which can be tolerated by the present process to produce acceptable grade calcium will be discussed in more detail, infra. In any event, skim having acceptable levels of contaminants can generally be prepared by blending skim known to have high levels of contaminants with skim known to have low levels of contaminants.

Skim should also preferably have a low dust content. Skim dust presents a contaminant problem because it tends to remain suspended above the agitating molten slag after charging thereto and, as such, has a tendency to become entrained in the calcium vapor escaping from the slag. As a result, the dust is transported to the condenser where it contaminates the condensing calcium. It has been found that screening is an effective way of removing dust from the skim and that skim particles large enough to be retained by an 8-mesh (Tyler Series) screen are generally heavy enough to fall through the escaping calcium vapor, make contact with the slag and react therewith. In addition, treating or washing skim particles with water during screening or subsequent thereto has been found to result in even greater dust removal.

"Aluminum shot" as used herein means semi-spherical, substantially pure aluminum pellets (i.e., containing more than 95% by weight aluminum) having a weight similar to that required for skim particles, i.e., heavy enough to contact and react with the molten slag upon being charged to the reaction zone. In contrast to skim particles, however, aluminum shot pellets, because of their greater density, can be somewhat smaller than the skim particles. In a preferred embodiment, the pellets generally range from about $\frac{5}{8}$ inch to $\frac{1}{8}$ inch in diameter.

The pellets, as preferably contemplated herein, are prepared from a low-cost source of aluminum such as aluminum scrap or aluminum skim. If the source is skim, the free aluminum contained therein is what the pellets are made from. Accordingly, to make aluminum shot from skim, the free aluminum in the skim must first be separated from the aluminum oxides contained therein. Those skilled in the art will be familiar with numerous processes for such separation. One process found to be suitable involves the use of salt fluxes wherein a rotary barrel salt furnace, such as that described in U.S. Pat. No. 3,468,524 to C. W. Haack, is charged with rock salt or another halide skim flux. The salt is melted to form a molten salt slag. Skim is then added and, after a period of time, the salt wets the aluminum oxide contained in the skim causing the molten free aluminum to coalesce or collect in the bottom of the furnace, thereby permitting it to be tapped from the furnace.

One process for forming molten aluminum into pellets, whether obtained from skim, as described above, or by melting scrap aluminum, involves feeding molten aluminum into troughs which feed into drop pans, each pan bottom being perforated with several 0.1-inch holes. The pans are positioned on a frame which is vigorously vibrated with a mechanical hammer assembly. The molten aluminum poured into the pans forms into droplets as it falls through the holes. The molten droplets fall into a water-filled pit where, upon contact with the water, they quickly solidify to take their final pellet shape. A bucket conveyor may then be employed to constantly lift the pellets from the bottom of the water pit and feed them into a gas-fired, horizontal rotary dryer. When dry, the pellets, now referred to as shot, are ready for charging to the reaction zone of the present process for producing calcium. Shot produced as described has a nonfriable, smooth surface which makes it extremely resistant to dust formation, which might otherwise result from handling or transporting the shot or upon charging the shot into the reaction zone of the present process for producing calcium.

As with skim, to produce acceptable grade calcium, the aluminum shot must not contain troublesome levels of high vapor pressure substances. These levels will be discussed in more detail, infra.

Referring now to the FIGURE, an apparatus 10 for producing calcium by a thermal reduction process is illustrated. Apparatus 10 comprises a reaction-condensation system having a reaction zone 12 and a condensation zone 14. Reaction zone 12 is bounded by an outer steel shell 16. Inside this shell is a thermally insulating refractory lining 18 and an internal carbon lining 20. Electrode 22, preferably of copper and water-cooled, extends through electrically insulating sleeve 24 into the reaction zone. At the lower end of electrode 22 is graphite cylinder 26. Carbon lining 20 serves as the hearth electrode, and embedded in this lining is current lead 28, which is suitably insulated from contact with steel shell 16. In the lower part of the reaction zone is tap hole 30, which is used to remove residual slag from the reaction zone. This tap hole is tightly closed when the system is in operation. In the upper part of the reaction zone is inlet 32, through which the reducing agent and the calcium oxide ore are introduced into the reaction zone.

Tuyere 34 serves as the passage through which calcium vapors produced in the reaction zone are conducted to the condensation zone. Flange connector 36, which is adapted to be cooled by circulating water, connects reaction zone 12 to condensation zone 14. The upper portion of condensation zone 14 is bounded by a continuation of steel shell 16 and thermally insulating refractory lining 18. In the upper portion of the condensation zone are located vacuum pump inlet pipe 38 and elbow 40. Inlet pipe 38 provides access to the reaction-condensation system for maintaining and controlling the desired pressure conditions therein. Elbow 40 cools the calcium vapors to facilitate condensation of calcium vapors in crucible 42 where condensed calcium is collected.

The present invention may be carried out in a reaction-condensation system such as apparatus 10. In carrying out this process, a molten oxide slag is provided and maintained in the reaction zone. The reducing agent and the calcium containing material may be mixed together and melted in the reaction zone to form a slag of the desired composition, or a suitable slag from a previous operation may be used.

A suitable slag may be formed by charging to the reaction zone and melting therein a material containing at least 95 wt. % calcium oxide and a reducing agent containing aluminum. Since commercially available aluminum prepared in a suitable form for charging to the reaction zone is expensive, aluminum is preferably provided by using low-cost particles of aluminum skim or shot (defined, supra), both of which should preferably have a low dust content. Low dust content, as previously mentioned, is advantageous in that it minimizes transport of dust to the condensation zone by the calcium vapor produced in the reaction zone.

A calcium containing material having the above-mentioned composition and providing good results is lime or calcined limestone. Preferred results may be obtained when the lime has less than 4 wt. % magnesium oxide and/or silicon dioxide ($SOi_2$). If aluminum skim is employed as the reducing agent, it has been found that preferred results can be obtained with skim containing 40 to 95 wt. % aluminum, the balance consisting essentially of aluminum oxide. As previously mentioned, aluminum shot should preferably contain 95 wt. % aluminum.

Also previously mentioned, it is desirable that the aluminum reducing agent have low levels of high vapor pressure substances. Zinc, copper and manganese have been found to be particularly troublesome and, preferably, the aluminum, whether shot or skim, should contain no more than 0.2 wt. % zinc, 1 wt. % manganese and 1 wt. % copper. In addition, it is particularly desirable that the skim contain as little aluminum carbide and aluminum nitride as possible. Preferably, the skim should contain no more than 0.5 wt. % aluminum carbide and no more than 0.5 wt. % aluminum nitride. Although it is not known exactly what effect the presence of these compounds has on the reaction, it is believed the aluminum dissociates from the nitrogen and the carbon in the reaction zone and forms oxides of carbon and nitrogen which are then transported to the condensation zone with the calcium vapor where back reaction occurs consuming calcium and producing calcium oxide and nitrides.

With respect to the operational considerations for the apparatus illustrated in the FIGURE, it should be noted that the amount of slag maintained in reaction zone 12 should be controlled so graphite cylinder 26 at the lower end of anode 22 is submerged. Such control can be provided by introducing the feed additives through inlet 32 and removing or tapping excess slag through tap hole 30. Numerals 44 and 46 indicate the minimum and maximum levels between which the slag should be maintained.

Slag composition is controlled by periodic or continuous addition of the ore and the reducing agent. Good results can be obtained by maintaining the composition of the slag to contain from 50 to 70 wt. % calcium oxide and 45 to 25 wt. % aluminum oxide, with the remainder containing less than 5 wt. % impurities. Thus, the weight ratio of calcium oxide to aluminum oxide in the slag should be maintained between about 2.8 and 1.1. Better results can be obtained by maintaining the composition of the slag to contain from 50 to 63 wt. % calcium oxide and 47 to 34 wt. % aluminum oxide, with the remainder containing less than 3 wt. % impurities. This translates into a weight ratio of calcium oxide to aluminum oxide of between 1.9 and 1.1. Optimum results can be obtained with a slag containing 55 to 60 wt. % calcium oxide and 42 to 37 wt. % aluminum oxide, the balance again containing less than 3 wt. % impurities. The calcium oxide to aluminum oxide weight ratio for this slag composition should be between 1.6 and 1.3. To keep the concentration of calcium oxide below the upper limits, therefore, sufficient amounts of aluminum reducing agent should be added to the slag. Normally, this will mean that aluminum in the feed mix of lime and aluminum reducing agent should be in an amount of up to 10% in excess of the amount required to obtain the desired slag composition.

The primary slag impurities referred to above are magnesium oxide and silicon dioxide. They typically enter the slag via limestone and their presence in the slag should be minimized by selecting limestone sources having low levels of such. The levels of other vapor transporting impurities, such as Mg, Mn, Cu, Zn and Sn, which typically enter the slag via the aluminum reducing agent should also be monitored. Again, the presence of these impurities can be minimized by selecting sources of aluminum (whether skim, shot or other aluminum sources) having low levels of such. It is believed that by carefully selecting the sources of calcium and reductant, high purity, pharmaceutical grade calcium having greater than 99 wt. % calcium can be produced. To produce such calcium, the calcium containing material should contain at least 98 wt. % calcium oxide and no more than 0.5 wt. % magnesium oxide. The reductant should contain at least 99 wt. % aluminum and no more than 0.5 wt. % zinc, 0.5 wt. % manganese or 0.5 wt. % magnesium.

Reaction zone temperature should be maintained between 1500° and 1800° C. during operation of the process. With slag compositions having a high calcium oxide content, i.e. those above 62 wt. %, reaction zone (i.e. furnace) temperature should be closely monitored and maintained above 1730° C. since the desired furnace superheat for such slags is about 200° to 250° C. and such slags freeze at 1535° C. Operation with slags having a calcium oxide content between 50 and 63 wt. % is more desirable since furnace temperatures do not have to be maintained quite as high. These slags typically freeze around 1400° C. Thus, with a furnace superheat of 200° C., satisfactory operation can be sustained with furnace temperatures around 1600° C. Slags having calcium oxide concentrations below 50 wt. % are believed to be undesirable since the reaction pressure of evolving calcium vapors will probably be too low to effect any meaningful transport of calcium vapor to the condenser.

Pressure within the reaction zone during process operation should be maintained below 50 torr, and preferably below 20 torr, with optimum results obtainable at pressures around or below 10 torr. An operating pressure range which has been found to provide good results is between 5 and 20 torr.

When the process is carried out as has been described herein, the aluminum reducing agent reacts in the reaction zone of the system with the slag or with calcium oxide in the presence of the slag to produce calcium vapor. This vapor is evolved from the surface of the slag and transported to the condensation zone of the system, where it is condensed and collected. An inert gas, such as argon or hydrogen, may be used to prevent air from contacting the calcium. As the reaction proceeds, the slag level in the reaction zone increases. Thus, from time to time, a portion of the slag and any unreacted components of the reducing agent, such as iron, silicon, titanium, etc., are removed through tap hole 30.

Table I sets forth test data taken from four runs conducted to demonstrate the operability of the subject invention. The calcium containing material used in the tests was lime, and the aluminum reducing agent was aluminum shot containing approximately 98 wt. % aluminum. The runs were conducted in a production facility substantially similar to that illustrated in the FIGURE. Prior to the tests, the facility was used commercially to produce magnesium. The magnesium was produced by the thermal reduction process described in U.S. Pat. No. 4,478,637 to Christini et al. Since the Christini magnesium process utilizes silicon as a magnesium oxide reducing agent, a residual amount of silicon had adhered to the furnace walls in the form of silicon dioxide. Residual amounts of other process ingredients, such as magnesium oxide, had also collected or adhered to the furnace walls as well. Those skilled in the art will appreciate that this explains why the test slags had rather high concentrations of silicon dioxide. However, it can be seen from the test data that the presence of silicon dioxide decreased with every run, with the exception of Run 2. By the fourth run, the silicon dioxide level had dropped significantly (i.e., to 1.9 wt. % from Run 2's high of 5.1). It can also be seen that the magnesium oxide content of the slag dropped significantly during the test runs (i.e., from 0.4 wt. % in Run 1 to 0.1 wt. % in Run 4). More significantly, however, was the drop in the weight percentage of magnesium metal collected in the condenser which dropped from 62.6 wt. % in Run 1 to 8.14 wt. % in Run 4. Moreover, it is believed that further runs would have dropped this level to about 3 wt. %, and by selecting sources of lime and aluminum having low magnesium content, it is believed that the presence of magnesium could be lowered even further.

The weight percent of calcium metal collected in the condenser is set forth in the bottom row of Table I. In contrast to magnesium, calcium's presence increased with each run. The metal collected in Run 4 contained a surprising 89.3 wt. % calcium. This demonstrated, quite clearly, that the process not only works but, in fact, will work on a commercial scale. Moreover, since it is expected that further runs in the test facility will remove even more residual magnesium adhered to the furnace walls, even purer calcium should be obtainable, possibly containing up to 96% calcium. Furthermore, since this metal can be purified even further by subjecting it to conventional refining steps (which are well known to those skilled in the art), it is expected that after such refining, calcium having purity levels as high as 97 wt. % can be attained. Again, by carefully selecting the source of calcium and reductant, it is believed that high purity, pharmaceutical grade calcium can be produced with purities greater than 99 wt. % calcium.

It can also be seen in Table I that more aluminum per pound of calcium was fed into the furnace in Run 4 than in the three previous runs (see aluminum reducing agent/calcium oxide ore feed weight ratios). This produced the more desirable slag having higher aluminum oxide content (i.e., above 34 wt. %) and less calcium oxide content (i.e., below 63 wt. %) which, as previously mentioned, is desirable because the process can be run at lower temperatures without fear of slag freeze-up.

Exact temperature measurements were not taken during the test runs; however, random measurements and visual observation indicated that furnace temperatures fluctuated between 1500° and 1700° C. Furnace pressures were controlled at the pressures set forth in Table I. Table II sets forth analyses of the lime used in the test runs. Table III sets forth analyses of the metal collected in the condenser in the test runs. The reducing agent used in all of the test runs was aluminum shot having a diameter between $\frac{1}{8}$ inch and $\frac{5}{8}$ inch and containing more than 95 wt. % aluminum.

TABLE I

| | Run 1 | Run 2 | Run 3 | Run 4 |
|---|---|---|---|---|
| CaO ore feed (lbs) | 37,788 | 40,838 | 26,837 | 43,090 |
| Al reducing agent feed (lbs) | 6,155 | 6,841 | 4,487 | 8,007 |
| Al reducing agent/ CaO ore feed wt. ratio | 0.160 | 0.168 | 0.167 | 0.185 |
| Operating pressure (torr) | 10 | 9 | 7 | 7 |
| Slag Comp. (wt. %): | | | | |
| CaO | 66.4 | 66.9 | 67.9 | 62.5 |
| $Al_2O_3$ | 27.5 | 28.5 | 29.5 | 37.4 |
| MgO | 0.4 | 0.2 | 0.3 | 0.1 |
| $SiO_2$ | 4.9 | 5.1 | 3.9 | 1.9 |
| Weight of metal collected in condenser (lb) | 5,900 | 6,320 | 8,390 | 9,700 |
| Wt. % of Mg in collected metal | 64.0 | 34.4 | 11.9 | 8.3 |
| Wt. % of Ca in collected Metal | 35.0 | 64.9 | 87.2 | 90.9 |

TABLE II

| | (Lime Analysis, wt. %) | | | |
|---|---|---|---|---|
| | Run 1 | Run 2 | Run 3 | Run 4 |
| CaO | 96.4 | 96.9 | 95.8 | 95.6 |
| MgO | 1.2 | 1.3 | 1.8 | 1.7 |
| $SiO_2$ | 1.60 | 1.36 | 1.66 | 1.90 |
| $Al_2O_3$ | .53 | .24 | .46 | .56 |
| $Fe_2O_3$ | .26 | .21 | .28 | .31 |
| MnO | .003 | .004 | .008 | .010 |

TABLE III

| | (Condensed Metal Analysis, wt. %) | | | |
|---|---|---|---|---|
| | Run 1 | Run 2 | Run 3 | Run 4 |
| Zn | 0.04 | 0.02 | 0.01 | 0.01 |
| Cu | 0.01 | 0.00 | 0.00 | 0.00 |
| Ni | 0.00 | 0.00 | 0.00 | 0.00 |
| Fe | <0.01 | <0.01 | <0.01 | <0.01 |
| Mn | 0.57 | 0.35 | 0.37 | 0.33 |
| Si | 0.23 | 0.11 | 0.15 | 0.12 |
| Al | 0.11 | 0.11 | 0.28 | 0.25 |
| Mg | 62.6 | 32.7 | 11.4 | 8.14 |
| Na | 0.07 | 0.10 | 0.07 | 0.12 |
| Ca | 34.2 | 61.7 | 83.4 | 89.3 |
| K | <0.01 | 0.02 | 0.02 | <0.01 |
| Sn | <0.01 | <0.01 | <0.01 | <0.01 |

While the invention has been described in terms of preferred embodiments, the claims appended hereto are intended to encompass all embodiments which fall within the spirit of the invention.

What is claimed is:

1. A process for the recovery of calcium from a calcium containing material, the process occurring in a system having a reaction zone and a condensation zone, the process comprising the steps of:
(a) charging to the reaction zone a calcium containing material and a reducing agent containing aluminum;
(b) providing at least a partially molten calcium-aluminum oxide slag in the reaction zone, said slag containing 50 to 70% by weight calcium oxide and 45 to 25% by weight aluminum oxide, the remainder containing less than 5% by weight impurities;
(c) maintaining the reaction zone at a temperature and a pressure sufficient to produce calcium vapor;
(d) transporting the calcium vapor from the reaction zone to the condensation zone; and
(e) condensing the calcium vapor in the condensation zone.

2. The process of claim 1 wherein the material is calcined limestone.

3. The process of claim 1 wherein the temperature is between 1500° and 1800° C.

4. The process of claim 1 wherein the temperature is between 1500° and 1700° C.

5. The process of claim 1 wherein the material contains at least 95% by weight calcium oxide and less than 4% by weight magnesium oxide and silicon dioxide.

6. The process of claim 1 wherein the reducing agent is aluminum shot.

7. The process of claim 1 wherein the reducing agent is aluminum skim.

8. The process of claim 7 wherein the skim contains from 40 to 95% by weight aluminum.

9. The process of claim 1 wherein the slag contains 50 to 63% by weight calcium oxide and 47 to 34% by weight aluminum oxide, the remainder containing less than 3% by weight impurities.

10. The process of claim 1 wherein the slag contains 55 to 60% by weight calcium oxide and 42 to 37% by weight aluminum oxide, the remainder containing less than 3% by weight impurities.

11. The process of claim 1 wherein the pressure is below 50 torr.

12. The process of claim 1 wherein the pressure is below 20 torr.

13. The process of claim 1 wherein the pressure is maintained from about 5 to 20 torr.

14. The process of claim 1 wherein the weight ratio of calcium oxide to aluminum oxide in the slag is less than 2.8 and greater than 1.1.

15. The process of claim 1 wherein the weight ratio of calcium oxide to aluminum oxide in the slag is less than 1.9 and greater than 1.1.

16. The process of claim 1 wherein the weight ratio of calcium oxide to aluminum oxide in the slag is less than 1.6 and greater than 1.3.

17. The process of claim 1 wherein the slag contains less than 5 wt. % silicon dioxide.

18. The process of claim 1 wherein the slag contains less than 5 wt. % magnesium oxide.

19. A process for the recovery of calcium from a calcium containing material, the process occurring in a system having a reaction zone and a condensation zone, the process comprising the steps of:
(a) contacting a slag in said reaction zone at a temperature between 1500° and 1800° C. at a pressure below 50 torr with a reducing agent containing aluminum, the reducing agent contacting the slag to produce calcium vapor, the slag having a composition containing 50 to 70% by weight calcium oxide and 45 to 25% by weight aluminum oxide, with the remainder containing less than 5% by weight impurities; and
(b) removing the calcium vapor from the reaction zone to the condensation zone for purposes of condensing the calcium.

20. A process for the recovery of high purity calcium from a calcium containing material, the process occurring in a system having a reaction zone and a condensation zone, the process comprising the steps of:
(a) charging to the reaction zone a calcium containing material and a reducing agent, said calcium containing material containing at least 98 wt. % calcium oxide and less than 0.5 wt. % magnesium oxide, said reducing agent containing aluminum containing less than 0.5 wt. % zinc, 0.5 wt. % manganese and 0.5 wt. % magnesium;
(b) providing at least a partially molten slag in the reaction zone, said slag containing calcium oxide and aluminum oxide;
(c) maintaining the reaction zone at a temperature and a pressure sufficient to produce calcium vapor;
(d) transporting the calcium vapor from the reaction zone to the condensation zone; and
(e) condensing the calcium vapor in the condensation zone.

* * * * *